United States Patent [19]

Cook

[11] 4,061,101

[45] Dec. 6, 1977

[54] SAIL FURLING APPARATUS

[76] Inventor: Gregory Edward Cook, 3101 S. Wabash, Chicago, Ill. 60616

[21] Appl. No.: 771,189

[22] Filed: Feb. 23, 1977

[51] Int. Cl.[2] ..... B63H 9/10

[52] U.S. Cl. ..... 114/106; 114/90; 114/107

[58] Field of Search ..... 114/39, 90, 102, 103, 114/104, 105, 106, 107

[56] References Cited

U.S. PATENT DOCUMENTS

| | | | |
|---|---|---|---|
| 1,243,198 | 10/1917 | McDougall | 114/106 |
| 2,107,303 | 2/1938 | Ljungstrom | 114/106 |
| 3,260,230 | 7/1966 | Kauert | 114/102 |
| 3,285,215 | 11/1966 | Potter | 114/106 X |
| 3,332,384 | 7/1967 | Potter | 114/106 X |
| 3,483,840 | 12/1969 | Prölss | 114/39 X |
| 3,749,042 | 7/1973 | Jackson | 114/107 X |

FOREIGN PATENT DOCUMENTS

| | | | |
|---|---|---|---|
| 179,641 | 9/1935 | Sweden | 114/103 |
| 601,605 | 5/1948 | United Kingdom | 114/106 |

*Primary Examiner*—Trygve M. Blix
*Assistant Examiner*—Sherman D. Basinger
*Attorney, Agent, or Firm*—Anthony S. Zummer

[57] ABSTRACT

A sail furling apparatus having a fixed core for connection to a wind powered device is disclosed herein. A rotatable sail sleeve having a bore formed therein is rotatably mounted on the fixed core. A double sheet airfoil sail is connected to the rotatable sail sleeve. A boom sleeve is mounted beneath the rotatable sail sleeve and engages the core. A boom is connected to the boom sleeve and is positioned perpendicular to the core, the sail sleeve and the boom sleeve. A freely rotatable eccentric sheath substantially surrounds the sail sleeve. The freely rotatable eccentric sheath has a slot and the airfoil sail passes through the slot. A furling apparatus is used to rotate the sail sleeve to draw the airfoil sail into the eccentric sheath or release it from the eccentric sheath.

13 Claims, 5 Drawing Figures

SAIL FURLING APPARATUS

BACKGROUND OF THE INVENTION

In most mast and sail arrangements, whether for sailboats, iceboats or other devices, such as windmills, which utilize wind power, a sail is presented to the wind. Controlled amounts of sail area also must be easily changeable for varying wind conditions.

Conventional sails used on sailboats have only a single sheet which is drawn into the shape of an airfoil by the force of the wind. The amount of sail available for sailing can be roughly controlled by the distance the sail is hoisted up the mast. As a practical matter, however, the distance which the sail is hoisted up the mast usually remains constant while sailing since the conventional sail should be fully extended vertically when sailing. The effective conventional sail area is controlled by varying the angle the sail presents to the windstream.

Various sail furling mast constructions are known in which sails can be rolled around a mast core or sleeve. In previous constructions, however, the portion of the sail which is free joins the rolled-up portion of the sail at a tangent to the mast sleeve.

What is needed, then, is a sail furling apparatus which has a separated double sheet sail which may be rolled through a forward portion of a freely rotatable eccentric sheath.

SUMMARY OF THE INVENTION

A sail furling apparatus is herein disclosed which is adapted to be mounted perpendicularly on a wind-powered device. The sail furling apparatus includes a fixed core which is connected to the device. A sail sleeve, having a central bore, surrounds the core and is rotatable thereabout. A boom sleeve is positioned below the sail sleeve. The boom sleeve is also free to rotate about the core. A boom arm is connected substantially perpendicular to the boom sleeve. A freely rotatable eccentric sheath, having an offset circular bore, surrounds the sail sleeve loosely. The eccentric sheath has a front slot. An airfoil sail, having a pair of sheets, is fixedly connected to the sail sleeve. Both sheets of the airfoil sail pass through the front slot of the freely rotatable eccentric sheath. A furling rigging is drivingly connected to the sail sleeve. The furling rigging is also drivingly connected to the airfoil sail.

In operation, the two sheets of the airfoil sail pass through the eccentric sheath front slot and run along the boom. The horizontal extension of the sail from the eccentric sheath is governed by the position of the furling rigging. The sail area which intercepts a wind stream may be increased by rotating the furling rigging in a first direction to draw both sheets of the airfoil sail out of the eccentric sheath front slot. The furling rigging can also be rotated in the opposite direction to draw the airfoil sail's sheets around the sail sleeve within the bore of the eccentric sheath.

It is a principal object of the present invention to provide a sail furling apparatus which can control the amount of sail exposed to the wind.

It is another object of the present invention to provide a sail furling apparatus having a double sheet airfoil sail.

It is still another object of the instant invention to provide a sail furling apparatus having a slotted exterior sheath which covers a rolled up portion of the sail.

Other objects and uses of the present invention will become obvious to a man skilled in the art upon a perusal of the following specification and claims in light of the accompanying drawings.

DESCRIPTION OF THE PREFERRED EMBODIMENT

Figure 1:
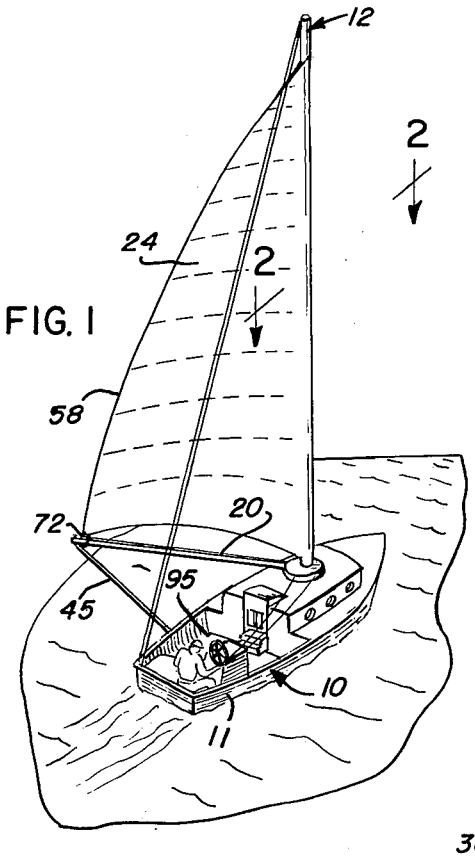
FIG. 1 is a perspective view of a sailboat having an inventive sail furling apparatus attached thereto.
Figure 2:
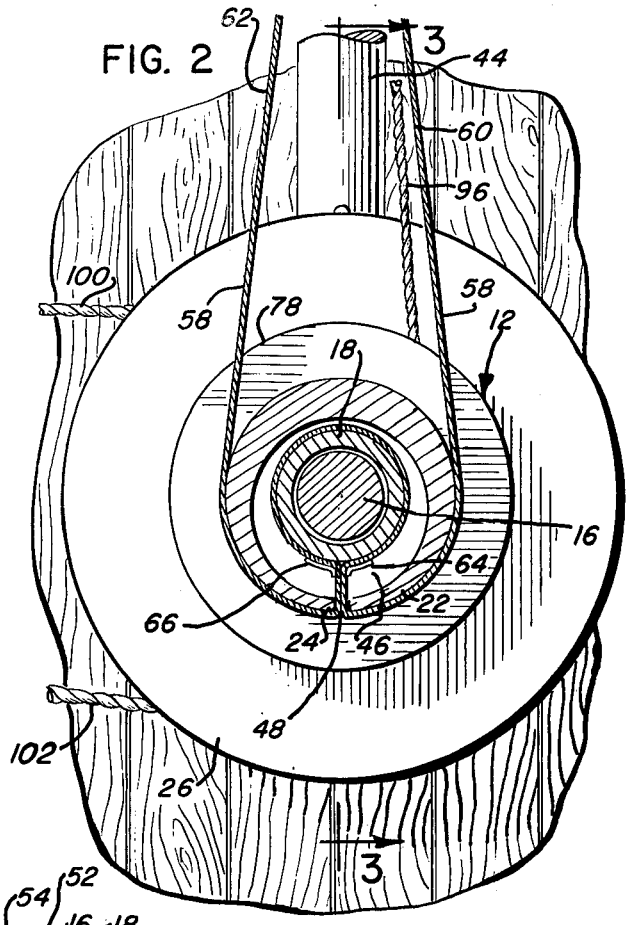
FIG. 2 is a sectional view taken along line 2—2 of FIG. 1, showing details of the interior arrangement of the inventive sail furling apparatus.

Referring now to the drawings, and especially to FIGS. 1 and 2, a sailboat 10, having a hull 11 and having a sail furling apparatus 12 embodying the instant invention connected to hull 11, is disclosed therein. Sail furling apparatus 12 is perpendicularly mounted on hull 11 of sailboat 10. Sail furling apparatus 12 includes a central core 16 which is connected to hull 11. A sail sleeve 18 surrounds core 16. A boom 20 is mounted beneath sail sleeve 18. An eccentric sheath 22 is mounted above boom 20. A double sheet airfoil sail 24 is connected to sail sleeve 18 and passes through eccentric sheath 22. A furling rigging 26 is connected to sail sleeve 18 to rotate sail sleeve 18.

Core 16 is a right circular cylindrical core having a top end 28 and a bottom end 30. Core 16 is affixed perpendicular to hull 11 at bottom end 30. A core sleeve 32 surrounds bottom end 30 of core 16. Core sleeve 32 is also affixed perpendicular to hull 11.

Sail sleeve 18 surrounds core 16. Sail sleeve 18 is a hollow right circular cylindrical sail sleeve having a right circular cylindrical central bore 34 which receives core 16. A ball bearing 36 rotatably connects sail sleeve 18 to top end 28 of core 16. Sail sleeve 18 is rotatable around core 16.

Boom 20 includes boom sleeve 38 having a right circular cylindrical bore 40. Bore 40 receives bottom end 30 of core 16. A ball bearing 42 is positioned between core sleeve 32 and boom sleeve 18. Sail sleeve 18 is positioned above boom sleeve 38. A boom arm 44 is rigidly connected to boom sleeve 38 and is positioned perpendicular to boom sleeve 38. Boom arm 44 is a right circular cylindrical boom arm. A boom strut 45 is connected to boom arm 44.

Eccentric sheath 22 has an eccentric right circular cylindrical bore 46. Bore 46 receives sail sleeve 18. Bore 46 is contiguous with a front slot 48. A wall thickness of eccentric sheath 22 is a minimum adjacent front slot 48. Eccentric sheath 22 terminates in a top cap 50. Cap 50 is rotatably mounted on a ball bearing 52. Ball bearing 52 is mounted on top end 28 of core 16. A threaded fastener 54 penetrates cap 50 and top end 28 of core 16. Threaded fastener 54 holds cap 50 in engagement with bearing 52. A ball bearing 56 rotatably connects eccentric sheath 22 to sail sleeve 18. Eccentric sheath 22 is freely rotatable about sail sleeve 18.

Airfoil sail 24 includes a pair of sail sheets 58, respectively numbered 60 and 62. Sheet 60 is formed integral with sheet 62. Sail sheet 60 is connected to sail sleeve 18 by a clip 64. Sail sheet 62 is connected to sail sleeve 18 by a clip 66. Sail sheets 60 and 62 pass through front slot 48 of eccentric sheath 22. Sail sheets 60 and 62 are identical, and are triangular in configuration. Sheets 60 and 62 are joined at a clew 68. Clew 68 has an eye 70 formed therein. A keeper ring 72 passes through eye 70 and engages boom arm 44. Keeper ring 72 holds clew 68 in proximity with boom arm 44.

Figure 3:
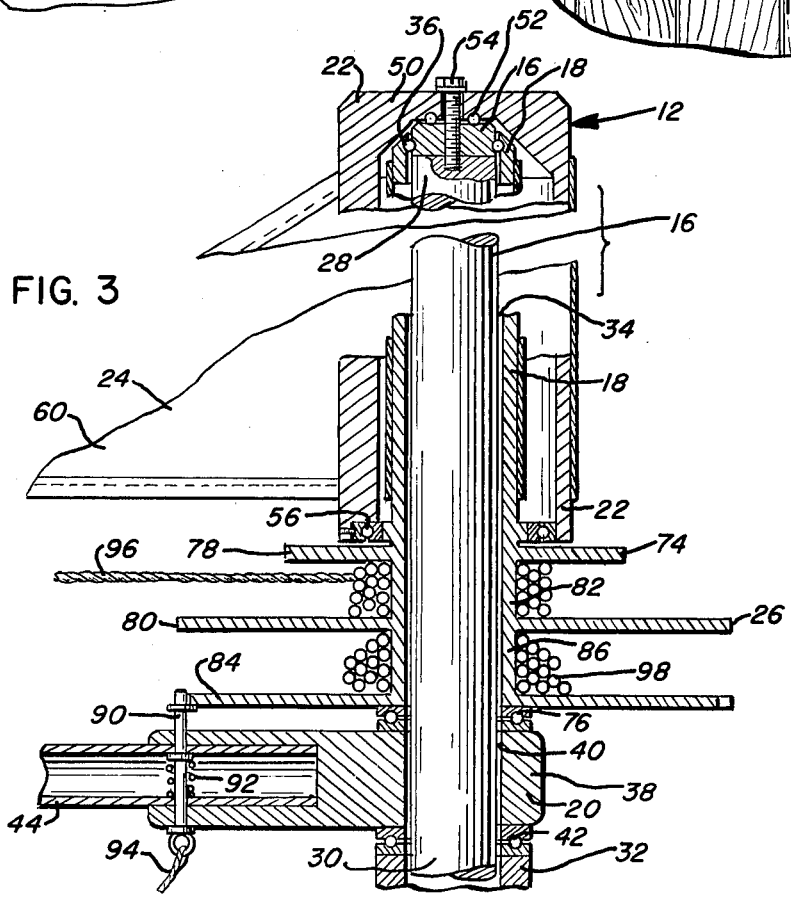
FIG. 3 is a sectional view taken along line 3—3 of FIG. 2, having portions broken away to show details of a furling rigging of the inventive sail furling apparatus.
Figure 4:
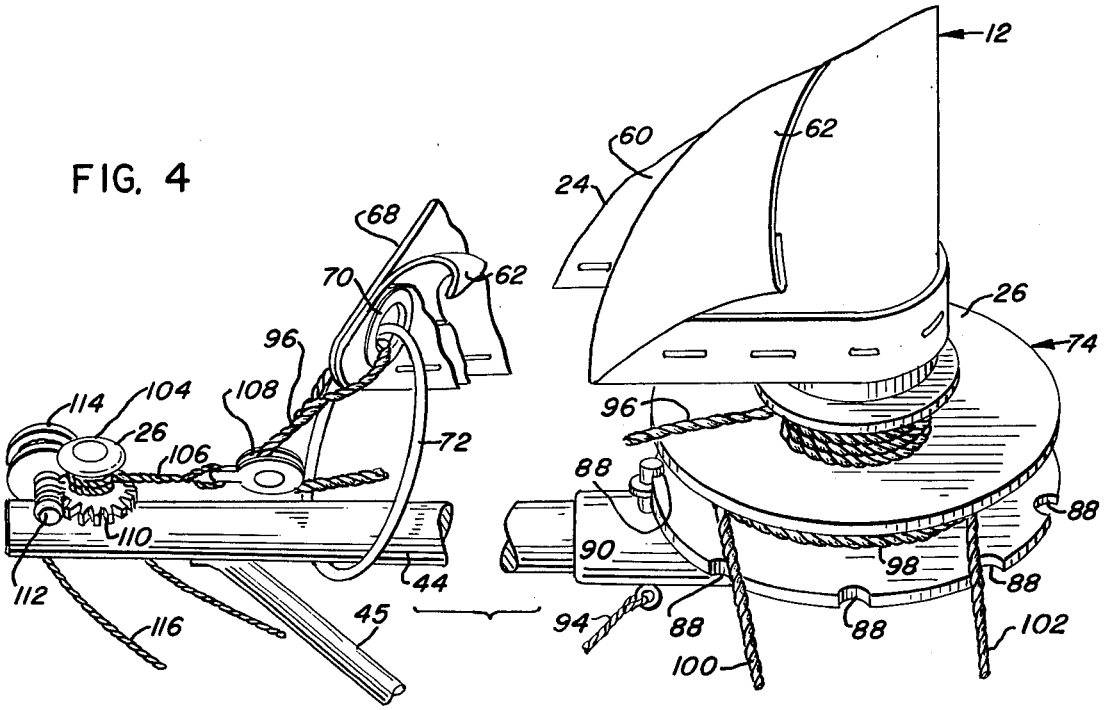
FIG. 4 is an enlarged perspective view of the inventive sail furling apparatus of FIG. 1, having portions broken away to show details of a manual furling rigging.

Referring now to FIGS. 3 and 4, manual furling rigging 26 is shown therein. Furling rigging 26 includes a sail wheel 74, which is connected to sail sleeve 18 above boom sleeve 38. A ball bearing 76 rotatably connects sail wheel 74 to boom sleeve 38.

Sail wheel 74 has a top disc 78, a middle disc 80 (separated from top disc 78 by a winding hub 82), and a bottom disc 84 (separated from middle disc 80 by a control hub 86). Bottom disc 84 engages ball bearing 76. Bottom disc 84 has a plurality of semi-circular detents 88 formed about a periphery thereof at regular intervals. A latch pin 90 is mounted within boom arm 44 adjacent bottom disc 84. Latch pin 90 has a compression spring 92 to hold latch pin 90 in engagement with one of detents 88. A latch cable 94 is connected to latch pin 90. Latch cable 94 extends to a pilot area 95 of sailboat 10. A rewind cable 96 is wound around winding hub 82 in a direction opposite a direction which sail sheets 60 and 62 are wound around sail sleeve 18. Rewind cable 96 is connected to eye 70 of sail 24. A control cable 98, having a pair of control lines respectively numbered 100 and 102, is wound around control hub 86 and extends into the pilot area of sailboat 10.

Furling rigging 26 also includes a tension capstan 104 rotatably mounted on boom arm 44 opposite sail wheel 76. A tension cable 106 is wound around capstan 104. A pulley 108 is connected to tension cable 106. Rewind cable 96 passes around pulley 108. A capstan spur gear 110 is connected to capstan 104. Capstan spur gear 110 has a worm gear 112 connected to it. Worm gear 112 is connected to a tension control wheel 114. A tension control cable 116 is wound around control wheel 114 and extends into the pilot area of sailboat 10. Tension cable 116 can be secured to hull 11 to prevent unwanted rotation of tension capstan 104.

In operation, the pilot of sailboat 10 pulls on latch cable 94 to release latch pin 90 from detents 88. The furling rigging 26 is then rotated by pulling on control cable 98 to turn sail sleeve 18 and winding hub 82 to draw airfoil sail 24 out of eccentric sheath 22 through front slot 36. When the airfoil sail 24 is unfurled to a desired exposed area outside the eccentric sheath, the sail wheel 76 is rotated slightly to bring the semicircular detents 88 into engagement with latch pin 90 to lock airfoil sail 24 in a desired amount of extension. Tension on airfoil sail 24 is then adjusted by pulling on tension control cable 116 to place a desired amount of tension on tension cable 106 and sail 24.

The sailboat 10 may then be sailed upwind conventionally with one of the two sheets of airfoil sail 24 facing into the wind whether the boom 32 is swung to port or starboard. The eccentric sheath 22 causes sail sheets 60 and 62 to be partially separated, adding to the airfoil shape of sail 24. In addition, since eccentric sheath 22 is free to rotate and the airfoil sail 24 issues from front slot 36, the airfoil sail 24 is positioned to face a full sail sheet into the wind without any of the sheet being blocked by the eccentric sheath 22 as might happen in other types of sail furling apparatus construction.

When the wind velocity changes, or the course of the sailboat changes, the amount of airfoil sail exposed to the wind can be quickly and easily changed by simply removing pin 90 from detents 88 and turning the furling rigging to either pay out additional sail or to roll up the airfoil sail inside the eccentric sheath. Once again, after the amount of sail surface has been changed, the detents 88 can be rotated into position and removable pin 90 locks the furling rigging in a stable position. Furthermore, angular position changes of boom 20 about core 16 do not vary the amount of sail exposed to the wind. The boom is locked to sail wheel 76 by latch pin 90. The eccentric sheath 22 is free to rotate and thus a constant sail area is maintained regardless of boom position.

Figure 5:
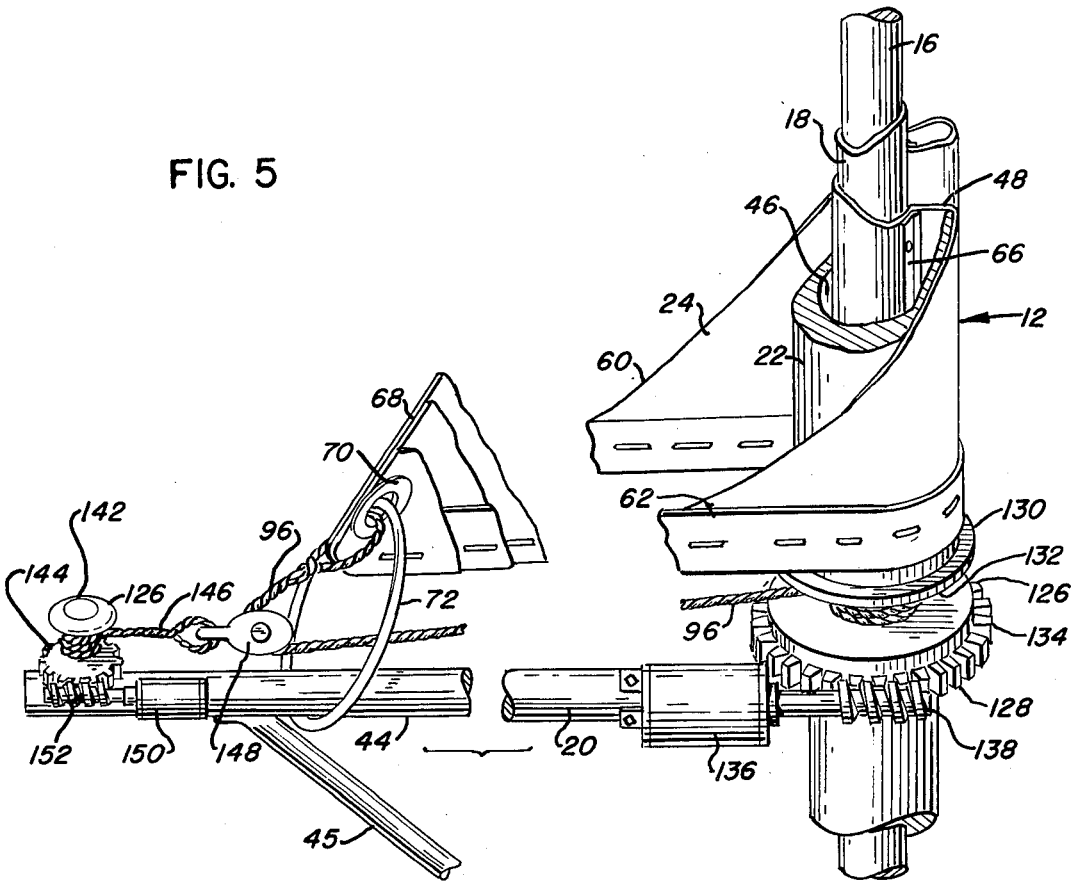
FIG. 5 is an enlarged view of a second embodiment of the inventive sail furling apparatus, also having portions broken away to show details of an electric furling rigging.

Referring now to FIG. 5 of the drawings, a second embodiment of the sail furling apparatus is shown therein. Most of the elements of the sail furling apparatus are identical to those disclosed in the first embodiment, with the exception of furling rigging 16. A furling rigging 126 is disclosed in FIG. 5. Furling rigging 126 is an electrically driven furling rigging. Furling rigging 126 includes a rotatable sail control wheel 128. Sail control wheel 128 has a top disc 130, a hub 132 connected to top disc 130 and a spur gear 134 connected to hub 132 opposite top disc 130. Top disc 130 is drivingly connected to sail sleeve 18. A reversible locking electric mast motor 136 is mounted on boom arm 44 adjacent spur gear 134. Electric mast motor 136 is selectively connectable to a suitable source of electrical energy. A worm gear 138 is connected drivingly to electric mast motor 136. Worm gear 138 is connected to spur gear 134. The rewind cable 96 is wound around hub 132 in a direction opposite a direction in which airfoil sail 24 is wound around sail sleeve 18.

A tension capstan 142 is rotatably mounted on boom arm 44 opposite sail control wheel 128. A spur gear 144 is drivingly connected to tension capstan 142. A tension cable 146 is wound around capstan 142. A pulley 148 is connected to tension cable 146. Rewind cable 96 is threaded through pulley 148. A reversible electric locking capstan motor 150 is mounted on boom arm 44 adjacent tension capstan 142. Electric capstan motor 150 is selectively connectable to a suitable source of electrical energy. A worm gear 152 is drivingly connected to electric motor 150 and spur gear 144.

The operation of the second embodiment of the sail furling apparatus 12 is identical to the operation of the first embodiment, with the exception of the operation of furling rigging 126. The electrical furling rigging 126 is operable by a switch or other electrical connector means to draw airfoil sail 24 out of eccentric sheath 22 or to wind airfoil sail 24 within eccentric sheath 22. When mast motor 136 receives an electrical current, it rotates in a first direction; and airfoil sail 24 is drawn out of eccentric sheath 22. The sail tension is then adjusted by capstan motor 150. When mast motor 136 receives a reversed electrical current, the motor rotates in the opposite direction and draws airfoil sail 24 within eccentric sheath 22 while paying out rewind cable 96. Since mast motor 136 and capstan motor 150 are locking motors, sail wheel 130 and capstan 142 are locked in position when current is not being supplied to motors 136 and 142. The electrical furling rigging is convenient to use since airfoil sail 24 can be trimmed at the touch of a switch. Furthermore, small changes in sail area exposed to the wind can be performed quickly and easily.

The sail furling apparatus disclosed herein provides an apparatus which enables a sailor to set the amount of sail which he presents to the wind quickly and easily. The sail furling apparatus also separates the sheets of the double sheet sail to form an airfoil sail. The apparatus can be placed on conventional sailboats and an amateur or week-end sailor is able to operate the apparatus more easily than he can operate conventional masts.

Although a specific embodiment of the inventive sail furling apparatus has been disclosed herein, it may be appreciated that one skilled in the art may make various modifications and changes in the specific embodiment without departing from the spirit and scope of the invention. It is to be expressly understood that the scope of the invention is to be limited only by what is claimed.

What is claimed is:

1. A sail furling apparatus for furling a sail on a mast comprising: a core; a sail sleeve rotatably mounted around said core; a sail connected to said sail sleeve; a freely rotatable exterior sheath positioned around the sail sleeve, said freely rotatable exterior sheath having a slot formed therein, said sail passing through said slot of said freely rotatable exterior sheath; a boom connected to said core and said sail; and a furling rigging connected to said sail, said furling rigging controlling an amount of sail which is drawn out of said freely rotatable exterior sheath.

2. A sail furling apparatus for furling a sail on a mast as defined in claim 1 in which said sail has a pair of sail sheets.

3. A sail furling apparatus for furling a sail on a mast as defined in claim 1 in which said core is a right circular cylindrical core.

4. A sail furling apparatus for furling a sail on a mast as defined in claim 1 in which said sail sleeve is a cylindrical sail sleeve having a central cylindrical bore, said central cylindrical bore receiving said core.

5. A sail furling apparatus for furling a sail on a mast as defined in claim 1 in which said boom includes a boom sleeve mounted beneath said sail sleeve, said boom sleeve receiving a portion of said core and being rotatably mounted around said core, a boom arm connected to said boom sleeve, said boom arm being positioned substantially perpendicular to an axis of rotation of said boom sleeve about said core.

6. A sail furling apparatus for furling a sail on a mast as defined in claim 1 in which said freely rotatable exterior sheath is a freely rotatable eccentric sheath, said freely rotatable eccentric sheath having an eccentric cylindrical bore formed therein, said eccentric sheath having a variable wall thickness, said variable wall thickness being at a minimum adjacent said slot of said freely rotatable eccentric sheath.

7. A sail furling apparatus for furling a sail on a mast as defined in claim 1 in which said sail has a first sheet and a second sheet, said first sheet and said second sheet passing through said slot of said freely rotatable exterior sheath, said first sheet being drawn in a first direction across said freely rotatable exterior sheath, said second sheet being drawn in a second direction across said freely rotatable exterior sheath, said first sheet and said second sheet terminating in a sheet apex which joins said first sheet and said second sheet together.

8. A sail furling apparatus for furling a sail on a mast as defined in claim 1 in which said furling rigging includes a sail wheel to which is connected a winding cable, said sail wheel being connected to said sail sleeve to rotate said sail sleeve, said winding cable being connected to an apex of said sail, said winding cable drawing said sail out of said freely rotatable exterior sheath as said sail sleeve is rotated by said sail wheel.

9. A sail furling apparatus for furling a sail on a mast as defined in claim 8 in which a tension capstan is mounted on said boom and is connected to said winding cable, said tension capstan adjusting tension placed upon said sail.

10. A sail furling apparatus for furling a sail on a mast comprising: a right circular cylindrical core; a right circular cylindrical sail sleeve having a central right circular cylindrical sail sleeve bore rotatably mounted around said right circular cylindrical core; a rotatable boom sleeve positioned below said right circular cylindrical sail sleeve around said core; a boom arm connected to said rotatable boom sleeve substantially perpendicular to said right circular cylindrical core; a freely rotatable eccentric sheath having an offset right circular cylindrical bore extending a length of said freely rotatable eccentric sheath, said freely rotatable eccentric sheath having a sheath wall having a varying thickness, said sheath wall having a minimum thickness adjacent a slot extending parallel to said offset right circular cylindrical bore; an airfoil sail having a pair of triangular airfoil sheets, each triangular airfoil sheet of said airfoil sail being fixedly connected to said right circular cylindrical sail sleeve for winding thereabout, said airfoil sail passing through said slot of said freely rotatable eccentric sheath, one of said triangular airfoil sheets being positioned in a first direction around said freely rotatable eccentric sheath, another of said triangular airfoil sheets being positioned in a second direction around said freely rotatable eccentric sheath; and a furling rigging having a sail wheel drivingly connected to said right circular cylindrical sail sleeve for rotation of said right circular cylindrical sail sleeve, a winding cable connected to said sail wheel, said winding cable drawing said airfoil sail out of said freely rotatable exterior sheath as said right circular cylindrical said sleeve is rotated, and a tension capstan connected to said boom arm opposite said sail wheel, said tension capstan having a tension cable connected thereto, said tension cable being connected to said winding cable to supply adjustable tension to said airfoil sail.

11. A sail furling apparatus for furling a sail as defined in claim 10 in which said furling rigging includes a plurality of detents formed in said sail wheel, and a latch pin mounted in said boom arm, said latch pin selectively lockingly engaging one of said detents in said sail wheel to prevent rotation of said sail wheel and sail sleeve with respect to said boom arm.

12. A sail furling apparatus for furling a sail as defined in claim 11 in which said sail wheel has a sail wheel control cable connected thereto and said tension capstan has a tension control cable connected thereto.

13. A sail furling apparatus for furling a sail as defined in claim 10 in which said sail furling rigging includes a first reversible locking electric motor, said first reversible locking electric motor being connected to said sail wheel to turn selectively said sail wheel, and a second reversible locking electric motor said second reversible locking electric motor being connected to said tension capstan to adjust tension on said airfoil sail.

* * * * *

UNITED STATES PATENT OFFICE
CERTIFICATE OF CORRECTION

PATENT NO. : 4,061,101
DATED : December 6, 1977
INVENTOR(S) : Gregory E. Cook

It is certified that error appears in the above-identified patent and that said Letters Patent are hereby corrected as shown below:

Column 6, Line 42, the second recitation of "said" should be --sail--.

Signed and Sealed this
*Eighteenth* Day of *April 1978*

[SEAL]

*Attest:*

RUTH C. MASON
*Attesting Officer*

LUTRELLE F. PARKER
*Acting Commissioner of Patents and Trademarks*